US005410328A

United States Patent [19]

Yoksza et al.

[11] Patent Number: 5,410,328

[45] Date of Patent: Apr. 25, 1995

[54] REPLACEABLE INTELLIGENT PIXEL MODULE FOR LARGE-SCALE LED DISPLAYS

[75] Inventors: David R. Yoksza, West Hartford, Conn.; Thomas M. Waltz, Richmond, Va.

[73] Assignee: Trans-Lux Corporation, Norwalk, Conn.

[21] Appl. No.: 218,769

[22] Filed: Mar. 28, 1994

[51] Int. Cl.[6] ..... G09G 3/32

[52] U.S. Cl. ..... 345/82; 345/83; 345/903

[58] Field of Search ..... 345/82, 83, 903; 362/249

[56] References Cited

U.S. PATENT DOCUMENTS

| | | | |
|---|---|---|---|
| 4,887,074 | 12/1989 | Simon et al. | 345/82 |
| 5,036,248 | 7/1991 | McEwan et al. | 313/500 |
| 5,268,828 | 12/1993 | Miura | 362/249 |

FOREIGN PATENT DOCUMENTS

| | | | |
|---|---|---|---|
| 3296796 | 12/1991 | Japan | 345/903 |
| 2164187 | 3/1986 | United Kingdom | 345/903 |
| WO8604439 | 7/1986 | WIPO . | |

*Primary Examiner*—Curtis Kuntz
*Assistant Examiner*—Minsun Oh
*Attorney, Agent, or Firm*—Kane Dalsimer Sullivan Kurucz Levy Eisele and Richard

[57] ABSTRACT

The apparatus is a detachable LED module which is used to display a pixel on a display. The LED module includes a rear wall and side walls. A plurality of LEDs along with a processor with input and output capabilities are contained within the LED module. The rear wall includes an aperture to receive an electrical jack from the display so as to communicate data, power and commands to the LED module. The input and output capabilities of the processors along separate data paths allow modules to be "daisy-chained" together with data intended for a single module to be passed through a succession of modules while commands are monitored from the ribbon cables and power is drawn therefrom.

34 Claims, 6 Drawing Sheets

REPLACEABLE INTELLIGENT PIXEL MODULE FOR LARGE-SCALE LED DISPLAYS

BACKGROUND OF THE INVENTION

This application is related to commonly-owned U.S. patent application Ser. No. 08/131,895 entitled "Circuit for Direct Drive of LED as Bulb Replacement" filed Oct. 5, 1993.

1. Field of the Invention

This invention pertains to a replaceable module for large-scale LED displays wherein the module can be removed from the array by merely removing a few screws or twisting the module and unfastening an electrical connector. The reverse procedure is used for connecting a new module to the display. The module includes processing means with both input and output capability allowing the module to be "daisy-chained" with successive modules to simplify the wiring of an LED matrix display.

2. Description of the Prior Art

In the prior art, it is well known to make displays with large-scale LED (light emitting diode) arrays. However, it has been difficult to replace the LEDs in these prior art displays if an LED or an LED module became inoperative. Typically, the replacement of an LED or an LED module required access to the rear of the display with the disconnection and re-connection of several wires extending from the control electronics to the LEDs or LED modules. This process was inefficient, time consuming and error prone.

Furthermore, in the prior art, large-scale LED arrays have had complicated wiring in that separate wires ran from a central processing unit to each of the individual modules, making any module replacement or reconfiguration inefficient, time consuming and error prone.

OBJECTS AND SUMMARY OF THE INVENTION

It is therefore an object of the invention to provide an LED module for a display, particularly a display with a large-scale LED array, wherein the module can be easily replaced.

It is therefore a further object of this invention to provide an LED module for a display, particularly a display with a large-scale LED array, wherein the module can be replaced without access to the rear of the display.

It is therefore a still further object of this invention to provide an LED module for a display, particularly a display with a large-scale LED array, wherein the initial wiring is simplified and any subsequent reconfiguration is similarly simplified.

It is therefore a still further object of this invention to provide an LED module for a display, particularly a display with a large-scale LED array, wherein the module can be replaced with a minimum of reconfigured electrical connections.

These and other objects are achieved by providing a plurality of LEDs within a module, typically one module per pixel. The module is attached to the face of the display by screws, a twist-on connector or similar fastening means. The rear face of the module includes an aperture through which an electrical connector with several prongs extends. The electrical connector and prongs releasably engage a complementary jack extending from an aperture in the face of the display. The electrical connector receives power, commands and data through the prongs. Power is drawn from a passing ribbon cable, commands are monitored from the passing ribbon cable, and data is input and output bi-directionally (on separate pins) from the ribbon cable through the prongs allowing for the module to pass data received from a previous module to a subsequent module. This allows a row of modules to be "daisy-chained" together thereby eliminating dedicated wiring from a central processor to each module thereby greatly simplifying the initial wiring and any subsequent replacement or reconfiguration of the modules. The power is used to power the processor and to light the LEDs as instructed by the received commands and data as processed through an intermediate processor within the module.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
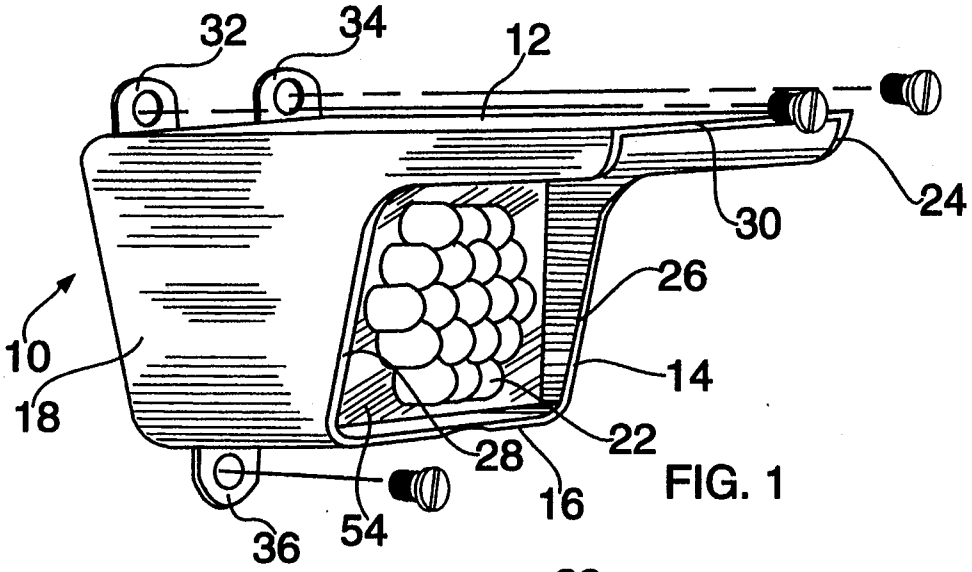
FIG. 1 is a perspective front view of the LED module of the present invention.
Figure 3B:
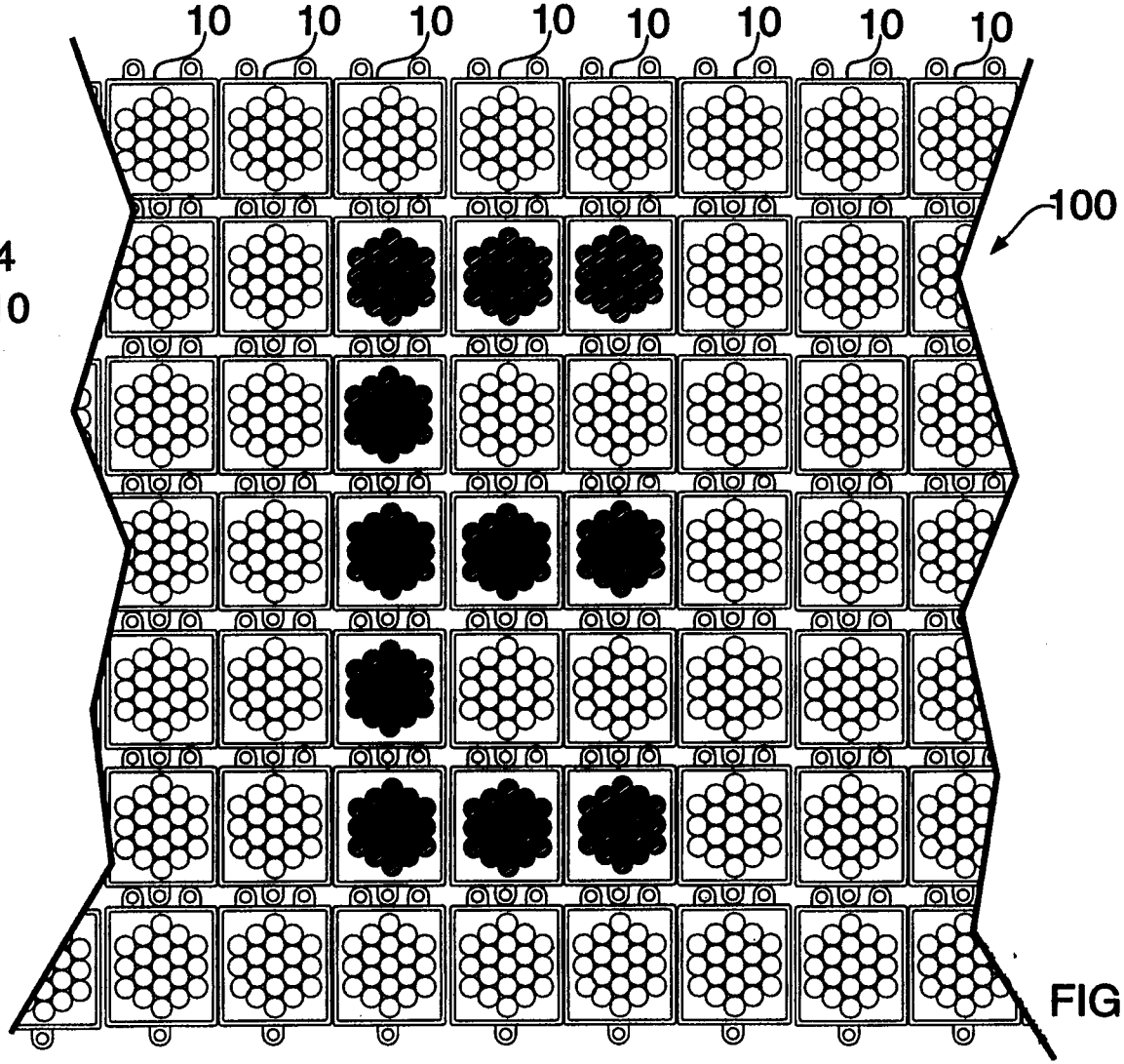
FIG. 3B is a front plan view of an array of the LED modules of the present invention thereby forming a large-scale display, displaying the pixels of the letter "E".
Figure 3A:
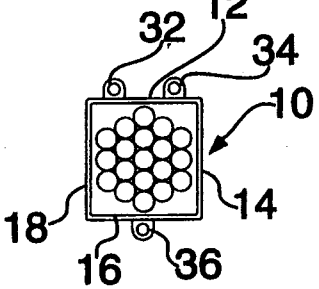
FIG. 3A is a front plan view, inclined slightly upwardly so that the line of sight is parallel with the top sunshade, of a first embodiment of the LED module of the present invention.

Referring now to the drawings in detail wherein like numerals indicate like elements throughout the several views, one sees a front perspective view of LED module 10 in FIG. 1, and a front plan view of the LED module 10 in FIG. 3A.

Figure 2B:
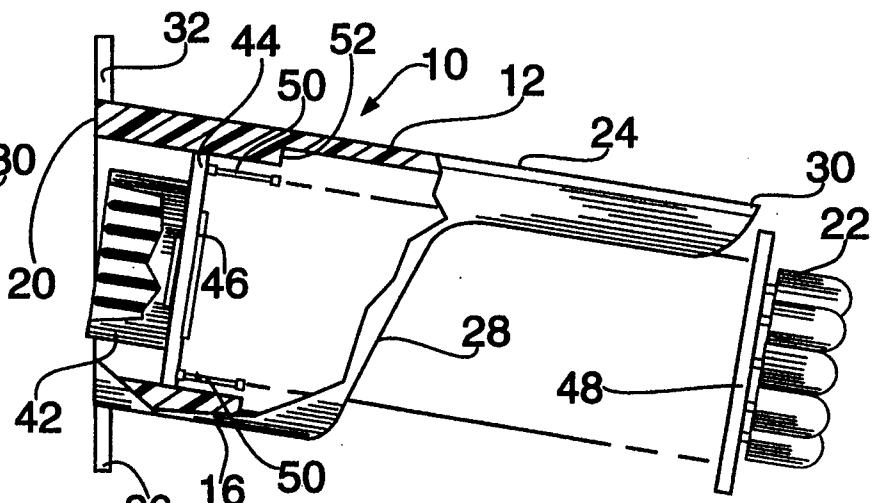
FIG. 2B is a side plan exploded view, partly in cut-away, of a first embodiment of the LED module of the present invention.
Figure 2A:
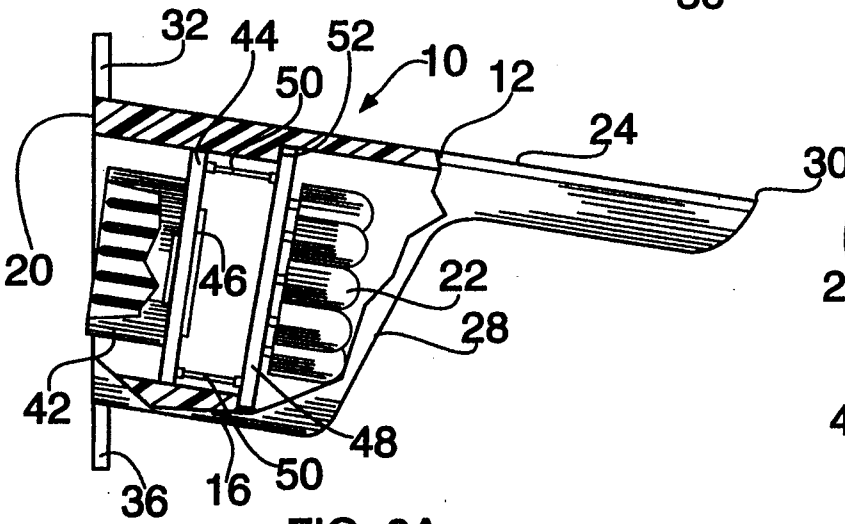
FIG. 2A is a side plan view, partly in cut-away, of a first embodiment of the LED module of the present invention.
Figure 4:
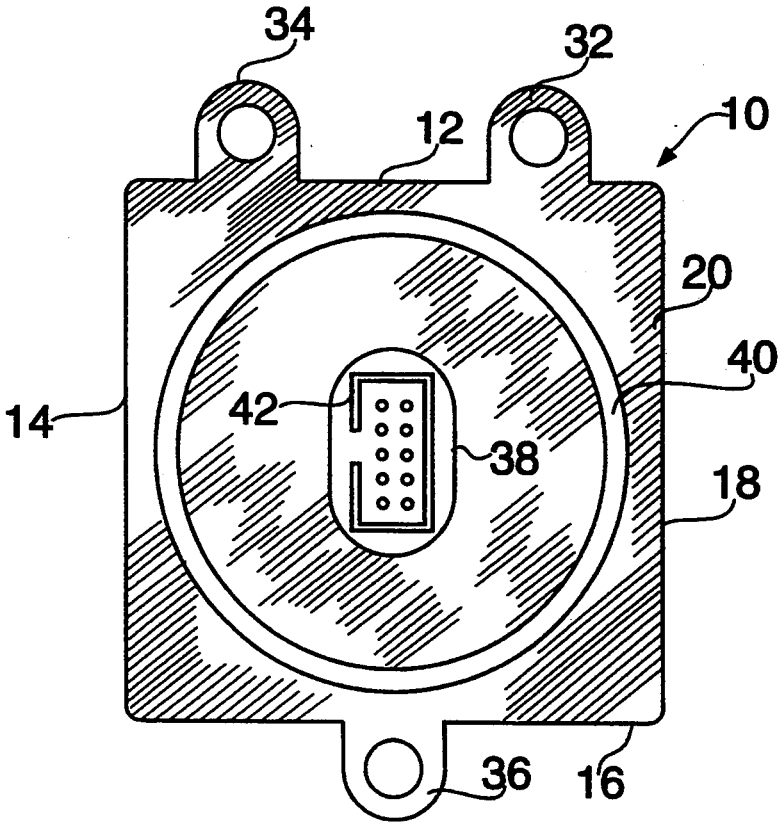
FIG. 4 is rear plan view of a first embodiment of the LED module of the present invention.

As viewed from the front as illustrated in FIG. 3A, the LED module 10 has a square cross section, with, in clockwise order, an upper wall 12, a right sidewall 14, a lower wall 16 and a left sidewall 18, respectively, at successive right angles to one another thereby forming a closed periphery with the LEDs 22 visible therebetween. The number and configuration of LEDs 22 as well as the shape of LED module 10 itself may be changed or varied with the various applications of LED module 10. As shown in FIGS. 2A, 2B and 4, a rear wall 20 is formed with edges intersecting walls 12, 14, 16, and 18. Rear wall 20 is somewhat inclined from a right angle with the upper wall 12 and the lower wall 16 so that when the rear wall 20 is attached to the vertical wall of a display 100 in the configuration of FIG. 3B, LED module 10 is inclined downwardly somewhat as such large-scale displays 100 are typically configured at a height where the viewer has to look upwardly at the display 100. In order not to obscure the view of the LED module 10 and the LEDs 22, the lower wall 16 is of a length not extending horizontally substantially beyond the position of the LEDs 22. Upper wall 12, however, extends well beyond the position of the LEDs 22 in order to form a sunshade 24, which shades the LEDs 22 from sunlight or other strong ambient light in order to enhance the visibility of the LEDs 22. As shown in FIGS. 1, 2A and 2B, sidewalls 14 and 18 include upwardly and outwardly inclined surfaces 26, 28, respectively, which rise from the outward edge of lower wall 16 toward upper wall 12 and sunshade 24. Immediately below sunshade 24, inclined surfaces 26, 28 curve outwardly and dip below the horizontal so as to be parallel with sunshade 24 until curving upwardly and reaching the outermost tip 30 of sunshade 24.

Two screw-hole tabs 32, 34 extend upwardly from the intersection of the upper wall 12 and the rear wall 20 at an inclination congruent with the rear wall 20. Similarly, screw-hole tab 36 extends downwardly from the intersection of the lower wall 16 and the rear wall 20 at an inclination congruent with the rear wall 20. Screw-hole tabs 32, 34, 36 allow the LED module 10 to be removably attached to the face of the display 100.

Figure 5:
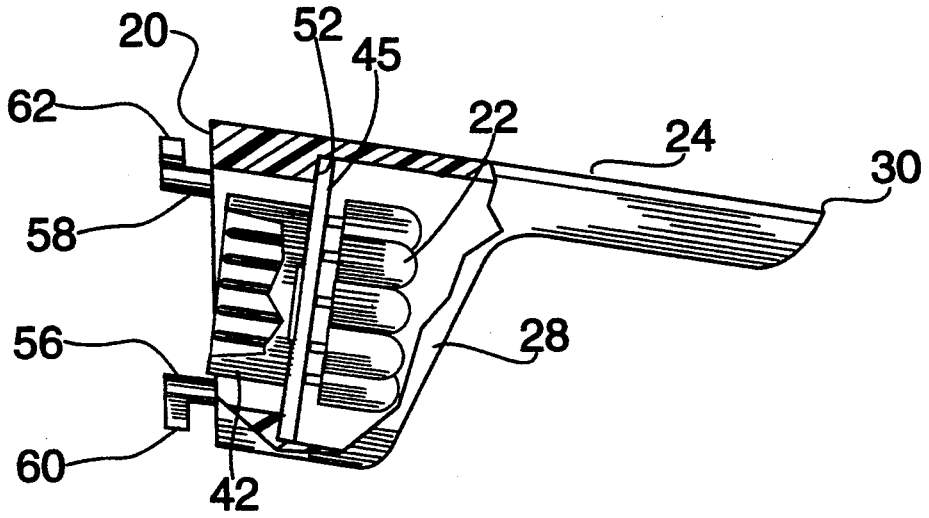
FIG. 5 is a side plan view, partly in cut-away, of a second embodiment of the LED module of the present invention.
Figure 6:
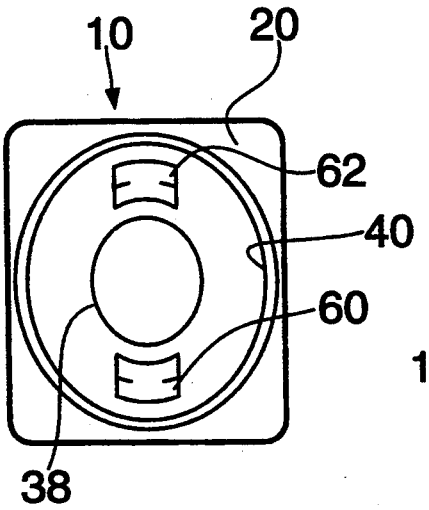
FIG. 6 is a rear plan view of a second embodiment of the LED module of the present invention.
Figure 7:
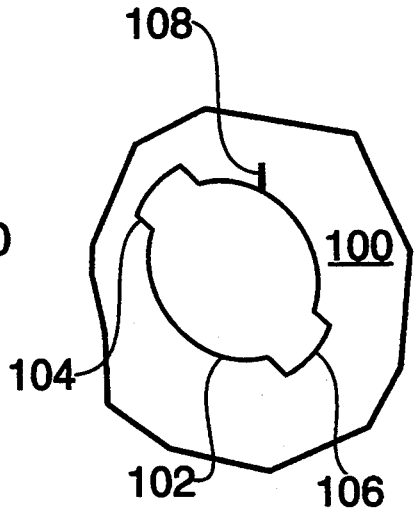
FIG. 7 is a plan view of a portion of the face of the display to engage the second embodiment of the LED module of the present invention.

Alternately, as shown in FIGS. 5 and 6, screw-hole tabs 32, 34, 36 can be replaced with L-shaped locking tabs 56, 58 with vertical portions 60, 62, respectively. The use of locking tabs 56, 58 in combination with a display 100 including a plurality of apertures 102 as illustrated in FIG. 7 (only one aperture shown) allows LED modules 10 to be twisted on and off. Locking tabs 56, 58 are inserted into detent channels 106, 104, respectively, and LED module 10 is twisted clockwise through approximately a forty-five degree angle until locking tab 58 engages stop notch 108.

Rear wall 20 includes a centrally located aperture 38 and a ring-shaped groove 40. Electrical jack 42 extends through centrally located aperture 38 to allow commands, electrical power and bi-directional data communication (on separate pins) from a complementary electrical jack (not shown) extending from display 100. The complementary electrical jack is in communication with ribbon cable 110 (see FIG. 8, described in detail hereinafter). Preferably, the centrally located processing unit (not shown) of the large-scale display 100 is programmed to provide commands and data to the LED module 10 for a single pixel of the display 100. However, configurations with more than one pixel within LED module 10 are certainly possible. The ring-shaped groove 40 engages a rubber O-ring (not shown) when mounted against the display 100 to provide water-tight seal to protect the electrical connections against the elements, particularly in an outdoor application.

Figure 8:
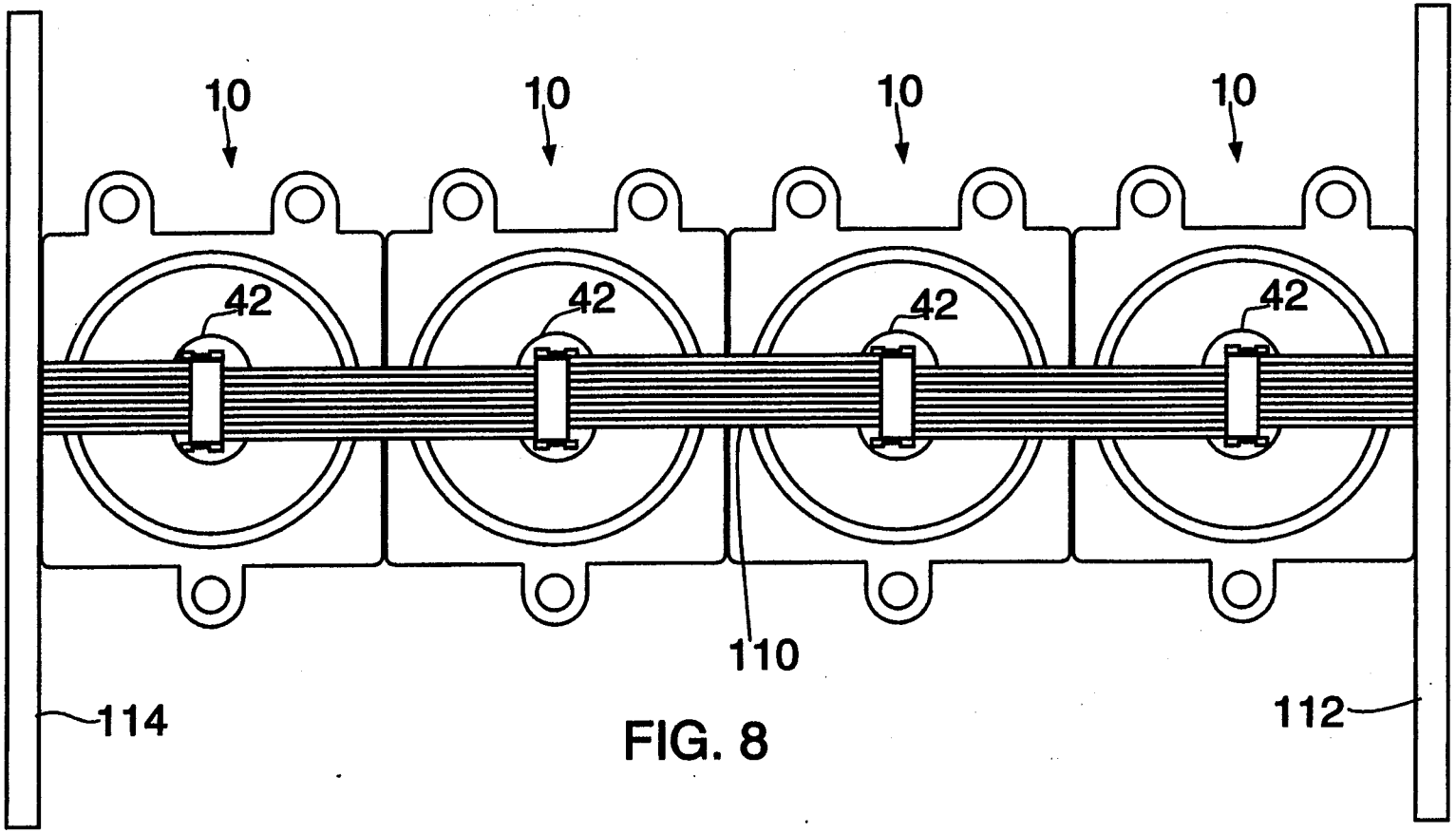
FIG. 8 shows a "daisy-chain" wiring configuration of successive LED modules of the present invention, along with the input board and driver board on the rear of the display of the present invention.
Figure 9:
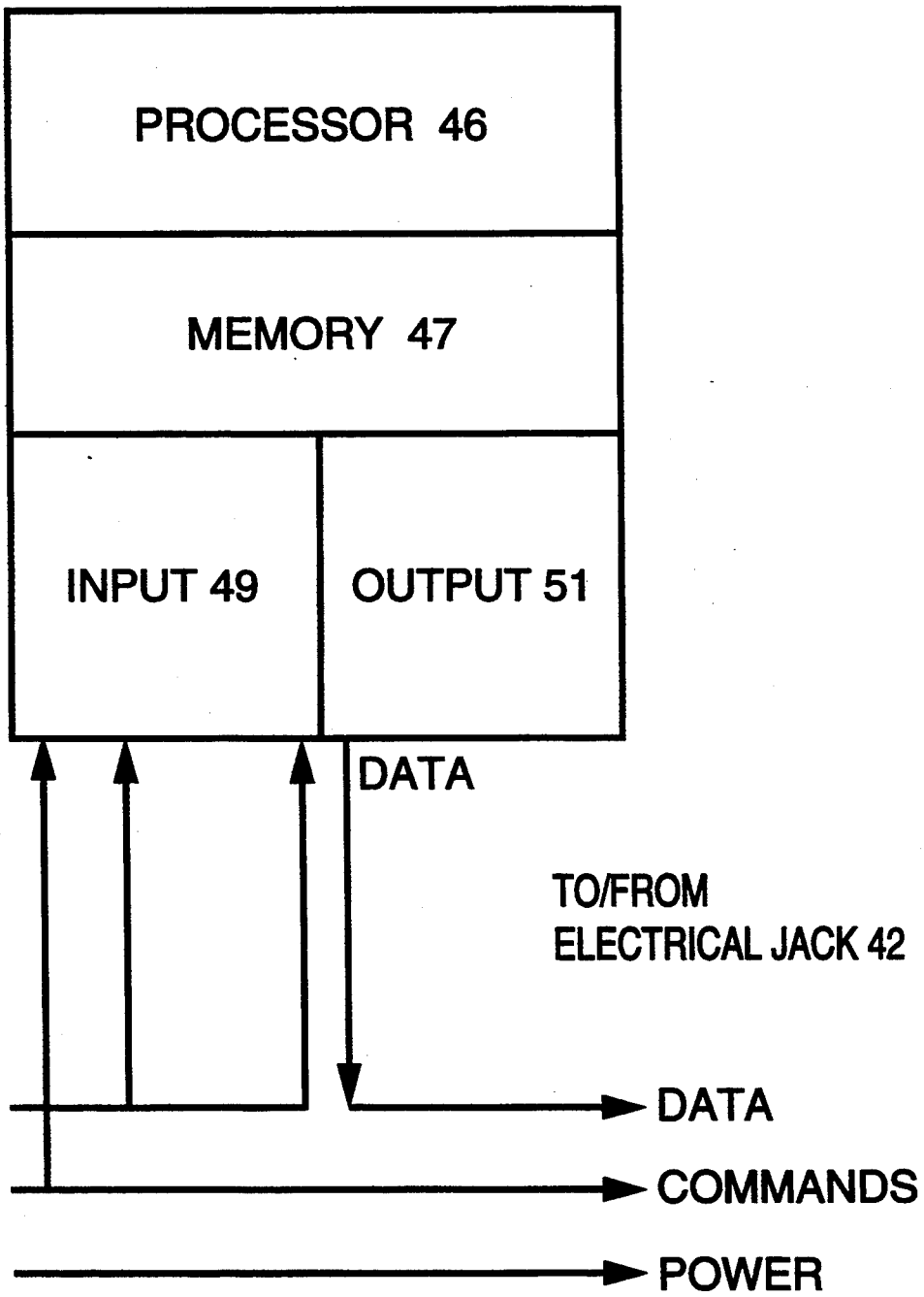
FIG. 9 is a schematic of the processing circuit of the present invention.

Electrical jack 42 is mechanically affixed to and in electrical communication with the LED driver board 44 which is positioned immediately in front of the electrical jack 42 and contains intermediate processing unit 46 for decoding the commands and data communicated through the electrical jack 42. As shown in FIG. 9, intermediate processing unit 46 includes memory 47, and input means 49 and output means 51 to receive and send data, respectively. Input means 49 further monitors commands via electrical jack 42. The input/output capability allows LED module 10 to receive data from a prior LED module, extract the data intended for LED module 10, and pass the remaining data to subsequent LED modules (while monitoring commands). This allows a "daisy-chain" configuration as shown in FIG. 8 with ribbon cable 110 running between LED modules carrying a stream of data, commands and power for the entire row of LED modules with data intended for a specific LED module being extracted from the data stream by the processing unit 46 of that LED module. Additionally, commands communicated along ribbon cable 110 are monitored by processing unit 46 and power for LED module 10 is drawn from ribbon cable 110. By eliminating dedicated wiring from a central processor to each LED module, the wiring of a large-scale display 100 is simplified.

Electrical jack 42 typically includes ten prongs which correspond to the ten wires of a ribbon cable. In order to facilitate the bi-directional communication of data on separate pins, sequential LED modules 10 are arranged so that a first LED module 10 in a row receives input data through the first pin and outputs data through the last or tenth pin. The next LED module 10 receives input data through the last or tenth pin and outputs data through the first pin. These two configurations are alternated. This requires alternating first and last wires to be removed from the ribbon cable 110 between successive LED modules 10 in order to maintain the proper data path and to reduce the likelihood of error in either the initial or subsequent configuration of the display 100.

As further shown in FIG. 8, data, power and commands for a row of LED modules 10 are initially provided by an input board 112 which is typically at an end of a row (i.e., an edge of the rear side of the display 100) to ribbon cable 110. Although not shown in FIG. 8, a single input board 112 typically provides information to several rows of LED modules 10. Similarly, a driver board 114 is placed on the rear of display 100 at a spacing of several LED modules 10 within a row. Driver boards 114 are used to buffer the commands and data signals and maintain the power (and provide shorter ground paths) being transmitted over ribbon cable 110. A typical driver board 114 extends for seven or eight rows of LED modules 10.

Referring back to FIGS. 2A and 2B, LED driver board 44 (not to be confused with element 114 of FIG. 8) is mechanically affixed to and in electrical communication with the LED display board 48 via pins 50. Alternatively, as shown in FIG. 5, LED driver/display board 45 can incorporate the functions of both LED driver board 44 and LED display board 48.

The LED display board 48 is positioned so as to abut the interior ledge 52 which is formed within the interior of the walls 12, 14, 16, 18 so as to be perpendicular therewith. LED display board 48 contains an arrangement of a plurality of LEDs 22, preferably mixed single-color LEDs (although use of LEDs all of the same color is suitable for some applications), oriented outwardly substantially parallel with the sunshade 24. As shown in FIG. 1, a thick layer 54 of polyurethane or a similar material is placed on an outward side of the LED display board 48, but not so as to obscure the arrangement of a plurality of LEDs 22, so as to seal the circuit boards 44 and 48 from the weather and elements.

To place the LED module 10 on the large-scale display 100, the user places an O-ring into ring-shaped groove 40. The user then attaches an electrical jack (not shown) extending from an aperture in the large-scale display 100 to the electrical jack 42 of LED module 10 and places the rear wall 20 flush against the face of the large-scale display 100 and aligns the screw-hole tabs 32, 34, 36 with corresponding apertures in the face of the large-scale display 100. The user then inserts screws into the screw-hole tabs 32, 34, 36 and the corresponding apertures in the face of the large-scale display 100 so as to secure the LED module 10 to the face of the large-scale display 100. Alternately, in place of the screw-hole tabs 32, 34, 36, one may substitute locking tabs 56, 58 and detent channels 104, 106 and a "twist-on-twist-off" configuration in achieved.

Additionally, the user should assure that the data input/output configuration for the first/last pins is compatible with adjacent LED modules.

Subsequent removal of the LED module 10, particularly if defective, is substantially the reverse of the above procedure and does not require access to the rear of the display 100.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. An LED module comprising:

a rear wall with sidewalls extending outwardly therefrom;

a plurality of LEDs secured between said sidewalls;

driver means, including processing circuit means, secured between said sidewalls in communication with said plurality of LEDs, said processing circuit means including input means for receiving data from a preceding similar LED module, output means for transmitting data to a subsequent similar LED module, and memory means;

an electrical jack in communication with said processing circuit means, said electrical jack providing power and bi-directional communication of data to said processing means via said input means and said output means from a preceding similar LED module and to a subsequent similar LED module, respectively;

an aperture within said rear wall providing access to said electrical jack; and means on at least one of said rear wall and said sidewalls for attaching the LED module to an external surface.

2. The LED module of claim 1 wherein said plurality of LEDs and an associated display circuitry are affixed to a first circuit board which is supported at least in part by said sidewalls.

3. The LED module of claim 2 wherein said first circuit board is supported at least in part by an interior ledge of said sidewalls.

4. The LED module of claim 3 wherein said driver means and said processing circuit means are affixed to a second circuit board, said first circuit board and said second circuit board being mechanically and electrically affixed to each other by pins.

5. The LED module of claim 1 wherein said processing circuit means, said plurality of LEDs, and an associated display circuitry are affixed to a single circuit board which is supported at least in part by said sidewalls.

6. The LED module of claim 1 wherein said sidewalls comprise a top wall, two lateral walls, and a bottom wall in a successive right angle configuration thereby forming a rectangular or square shape.

7. The LED module of claim 6 wherein said top and bottom walls are inclined slightly below the horizontal when said rear wall is inclined vertically.

8. The LED module of claim 7 wherein said plurality of LEDs are inclined substantially parallel to said top and bottom walls.

9. The LED module of claim 8 wherein said top wall extends substantially further outwardly than said bottom wall so as to form a means for shading said plurality of LEDs.

10. The LED module of claim 9 wherein an area immediately inward of said plurality of LEDs is covered with a polyurethane-like material to seal the LED module from exposure,

11. The LED module of claim 9 wherein said means for attaching the LED module to an external surface includes screw-hole tabs extending outwardly from said rear wall.

12. The LED module of claim 9 wherein said means for attaching the LED module to an external surface includes at least one tab extending outwardly from said rear wall to engage an aperture in the external surface.

13. The LED module of claim 12 wherein said at least one tab is L-shaped with a first portion substantially perpendicular from said rear wall and a second portion substantially perpendicular to said first portion, said at least one tab being adapted to twist on and off from an aperture in the external surface.

14. The LED module of claim 9 wherein said plurality of LEDs are mixed single color LEDs.

15. The LED module of claim 9 wherein said plurality of LEDs are all of a single color.

16. The LED module of claim 9 wherein said LED module represents a pixel in a display.

17. The LED module of claim 1 wherein said bi-directional communication is facilitated by two separate data paths.

18. A display comprised of a plurality of LEDs modules, each LED module representing a single pixel in the display, each said LED module comprising:

a rear wall with sidewalls extending outwardly therefrom;

a plurality of LEDs secured between said sidewalls;

driver means, including processing circuit means, secured between said sidewalls in electrical communication with said plurality of LEDs, said processing circuit means including input means for receiving data from a preceding similar LED module, output means for transmitting data to a subsequent similar LED module, and memory means;

an electrical jack in communication with said processing circuit means, said electrical jack providing power and bi-directional communication of data to said processing means via said input means and said output means from a preceding similar LED module and to a subsequent similar LED module, respectively;

an aperture within said rear wall providing access to said electrical jack; and means on at least one of said rear wall and said sidewalls for attaching the LED module to the display; and the display further including cables providing electrical communication between at least some adjacent LED modules, wherein data bound for a given LED module is passed through successive adjacent LED modules via said processing circuit means of said successive adjacent LED modules.

19. The display of claim 18 wherein said plurality of LEDs and an associated display circuitry are affixed to a first circuit board which is supported at least in part by said sidewalls.

20. The display of claim 19 wherein said first circuit board is supported at least in part by an interior ledge of said sidewalls.

21. The display of claim 20 wherein said driver means and said processing circuit means are affixed to a second circuit board, said first circuit board and said second circuit board being mechanically and electrically affixed to each other by pins.

22. The display of claim 18 wherein said processing circuit means, said plurality of LEDs, and an associated display circuitry are all affixed to a single circuit board which is supported at least in part by said sidewalls.

23. The display of claim 18 wherein said sidewalls comprise a top wall, two lateral walls, and a bottom wall in a successive right angle configuration thereby forming a rectangular or square shape.

24. The display of claim 23 wherein said top and bottom walls are inclined slightly below the horizontal when said rear wall is inclined vertically.

25. The display of claim 24 wherein said plurality of LEDs are inclined substantially parallel to said top and bottom walls.

26. The display of claim 25 wherein said top wall extends substantially further outwardly than said bottom wall so as to form a means for shading said plurality of LEDs.

27. The display of claim 25 wherein an area immediately inward of said plurality of LEDs is covered with a polyurethane-like material to seal said LED modules from exposure.

28. The display of claim 26 wherein said means for attaching the LED module to the display includes screw-hole tabs extending outwardly from said rear wall.

29. The display of claim 26 wherein said means for attaching the LED module to the display includes at least one tab extending outwardly from said rear wall to engage an aperture in the display.

30. The display of claim 29 wherein said at least one tab is L-shaped with a first portion substantially perpendicular from said rear wall and a second portion substantially perpendicular to said first portion, said at least one tab being adapted to twist on and off from an aperture in the display.

31. The display of claim 26 wherein said plurality of LEDs are mixed single color LEDs.

32. The display of claim 25 wherein said plurality of LEDs are all of a single color.

33. The display of claim 18 wherein said bi-directional communication is facilitated by two separate data paths.

34. The display of claim 33 wherein said two separate data paths alternate input and output functions between successive LED modules.

* * * * *